US008808474B2

(12) United States Patent
Ferrer et al.

(10) Patent No.: US 8,808,474 B2
(45) Date of Patent: Aug. 19, 2014

(54) HEAT TREATMENT OF MARTENSITIC STAINLESS STEEL AFTER REMELTING UNDER A LAYER OF SLAG

(75) Inventors: Laurent Ferrer, Lieusaint (FR); Patrick Philipson, Bois le Roi (FR)

(73) Assignee: SNECMA, Paris (FR)

( * ) Notice: Subject to any disclaimer, the term of this patent is extended or adjusted under 35 U.S.C. 154(b) by 142 days.

(21) Appl. No.: 13/501,610

(22) PCT Filed: Oct. 11, 2010

(86) PCT No.: PCT/FR2010/052142

§ 371 (c)(1),
(2), (4) Date: Apr. 12, 2012

(87) PCT Pub. No.: WO2011/045515

PCT Pub. Date: Apr. 21, 2011

(65) Prior Publication Data

US 2012/0199252 A1 Aug. 9, 2012

(30) Foreign Application Priority Data

Oct. 12, 2009 (FR) ..... 09 57110

(51) Int. Cl.
*C21D 1/84* (2006.01)
*C21D 6/00* (2006.01)

(52) U.S. Cl.
USPC ..... 148/542; 148/605; 148/607

(58) Field of Classification Search
None
See application file for complete search history.

(56) References Cited

U.S. PATENT DOCUMENTS

| | | | | |
|---|---|---|---|---|
| 6,273,973 | B1 * | 8/2001 | Parayil et al. | 148/542 |
| 6,451,136 | B1 | 9/2002 | Falkenreck et al. | |
| 2008/0314480 | A1 | 12/2008 | Wright et al. | |
| 2011/0206503 | A1 | 8/2011 | Ferrer et al. | |
| 2011/0211945 | A1 | 9/2011 | Ferrer et al. | |
| 2011/0268566 | A1 | 11/2011 | Ferrer et al. | |
| 2012/0132326 | A1 | 5/2012 | Ferrer et al. | |

FOREIGN PATENT DOCUMENTS

| | | |
|---|---|---|
| CN | 1624180 A | 6/2005 |
| CN | 1904116 A | 1/2007 |
| JP | 2001 262286 | 9/2001 |
| WO | 01 40526 | 6/2001 |
| WO | 2006 081401 | 8/2006 |

OTHER PUBLICATIONS

Machine—English translation of Japanese patent No. 2001-262286, Azuma Tsukasa et al., Sep. 26, 2001.*
U.S. Appl. No. 13/382,052, filed Mar. 23, 2012, Ferrer.

(Continued)

*Primary Examiner* — Deborah Yee
(74) *Attorney, Agent, or Firm* — Oblon, Spivak, McClelland, Maier & Neustadt, L.L.P.

(57) ABSTRACT

A method fabricating a stainless martensitic steel, including electroslag remelting then cooling an ingot of the steel, then at least one austenitic thermal cycle heating the ingot above its austenitic temperature followed by a cooling. During each cooling: if the cooling is not followed by an austenitic thermal cycle, holding the ingot at a holding temperature included in the ferritic-pearlitic transformation nose for a hold time longer than sufficient for transforming the austenite into a ferritic-pearlitic structure in the ingot as completely as possible at the holding temperature; if the cooling is followed by an austenitic thermal cycle, before its minimum temperature falls below the martensitic transformation start temperature, the ingot is either held throughout the period between the two austenitic thermal cycles at a temperature above the austenitic transformation completion temperature on heating, or held at the holding temperature included in the ferritic-pearlitic transformation nose.

8 Claims, 2 Drawing Sheets

(56) References Cited

OTHER PUBLICATIONS

U.S. Appl. No. 13/501,377, filed Apr. 11, 2012, Ferrer, et al.
U.S. Appl. No. 13/501,568, filed Apr. 12, 2012, Ferrer, et al.
Suresh, M.R., et al., "Relative anisotropy of structures and ultrasound attenuation response between laboratory casting in permanent mould (vacuum induction melted) and casting processed through electroslag refining," Ironmaking and Steelmaking, vol. 31, No. 5, pp. 409-416, (Oct. 2004) (Abstract only).
Fratesi, R., et al., "Hydrogen-Inclusion Interaction in Tempered Martensite Embrittled SAE 4340 Steels," Materials Science and Engineering, vol. A119, pp. 17-22, (1989).
International Search Report Issued Dec. 30, 2010 in PCT/FR10/52142 Filed Oct. 11, 2010.
Chinese Office Action issued in Application No. 2010800462034 on Jun. 13, 2013 (English Translation).

* cited by examiner

HEAT TREATMENT OF MARTENSITIC STAINLESS STEEL AFTER REMELTING UNDER A LAYER OF SLAG

BACKGROUND OF THE INVENTION

1. Field of the Invention

The present invention relates to a method of fabricating a stainless martensitic steel, comprising a step of electroslag remelting of an ingot of said steel then a step of cooling said ingot, then at least one austenitic thermal cycle consisting in heating said ingot above its austenitic temperature.

In the present invention, unless otherwise stated, the composition percentages are percentages by weight.

2. Description of the Related Art

A stainless martensitic steel is a steel with a chromium content of more than 10.5% and of a structure that is essentially martensitic.

It is important for the fatigue behavior of such a steel to be as good as possible so that the service life of parts produced from such a steel is maximized.

To this end, it is sought to improve the inclusion characteristics of the steel, i.e. to reduce the quantity of undesirable inclusions (certain alloy, oxide, carbide, and intermetallic compound phases) present in the steel. Such inclusions act as crack initiation sites that, under cyclic loading, result in premature failure of the steel.

Experimentally, a large dispersion is observed in the results of fatigue tests carried out on test specimens of that steel, i.e. for each level of fatigue loading under imposed deformation, the service life (corresponding to the number of cycles resulting in breaking of a fatigue specimen in that steel) varies over a wide range. Inclusions are responsible for the minimum values, in the statistical sense, for the fatigue service life of the steel (low values of the range).

In order to reduce that dispersion in fatigue behavior, i.e. in order to raise those low values, and also to enhance the mean fatigue behavior value, it is necessary to improve the inclusion characteristics of the steel. The electroslag remelting technique, ESR, is known. In that technique, the steel ingot is placed in a crucible into which a slag (mixture of minerals, for example lime, fluorides, magnesia, alumina, calcite) is poured such that the lower end of the ingot is immersed in the slag. Next, an electric current is passed through the ingot, which acts as an electrode. That current is sufficiently high to heat and liquefy the slag and to heat the lower end of the steel electrode. The lower end of that electrode is in contact with the slag, and so it melts and passes through the slag in the form of fine droplets, and then solidifies below the layer of slag, which floats, to form a new ingot that therefore grows gradually. The slag acts, inter alia, as a filter that extracts the inclusions from the steel droplets, such that the steel of that new ingot located below the layer of slag contains fewer inclusions than the initial ingot (electrode). That operation is carried out at atmospheric pressure and in air.

Although the ESR technique can reduce the dispersion in the fatigue behavior of stainless martensitic steels by eliminating inclusions, that dispersion is still too large in terms of the service life of the parts.

Non-destructive testing using ultrasound carried out by the inventors has shown that said steels include practically no known hydrogen defects (flakes).

The dispersion of the fatigue behavior results, specifically the low end values of the range of results, is thus due to another undesirable mechanism of premature initiation of cracks in the steel, which results in premature fatigue breaking.

BRIEF SUMMARY OF THE INVENTION

The aim of the present invention is to provide a fabrication method that can raise these low values and thus reduce the dispersion of the fatigue behavior of stainless martensitic steels and enhance its mean fatigue behavior.

This aim is achieved in that during each of the cooling steps:

- if the cooling step is not followed by an austenitic thermal cycle, said ingot is held at a holding temperature included in the ferritic-pearlitic transformation nose for a hold time that is longer than the period sufficient for transforming the austenite into a ferritic-pearlitic structure in said ingot as completely as possible at the holding temperature, the ingot being held at said holding temperature as soon as the temperature of the coolest point of the ingot has reached the holding temperature;
- if the cooling step is followed by an austenitic thermal cycle, before its minimum temperature falls below the martensitic transformation start temperature Ms, the ingot is either held throughout the period between said two austenitic thermal cycles at a temperature above the austenitic transformation completion temperature on heating, Ac3, or held at the holding temperature included in the ferritic-pearlitic transformation nose as above.

These means reduce the formation of gas phases of microscopic dimensions (not detectable by industrial non-destructive testing means) constituted by light elements within the steel, and thus avoid premature initiation of cracks from said microscopic phases, which give rise to premature failure of the steel under fatigue.

Advantageously, the ingot is placed in a furnace before the temperature of the skin of the ingot falls below the end of the ferritic-pearlitic transformation completion temperature on cooling, Ar1, which temperature Ar1 is higher than the martensitic transformation start temperature Ms.

BRIEF DESCRIPTION OF THE SEVERAL VIEWS OF THE DRAWINGS

The invention and its advantages can be better understood from the following detailed description of an implementation shown by way of non-limiting example. The description makes reference to the accompanying drawings in which.

DETAILED DESCRIPTION OF THE INVENTION

Figure 3:
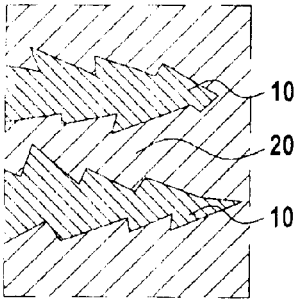
FIG. 3 is a diagram illustrating dendrites and interdendritic regions.

During the ESR process, the steel that has been filtered by the slag cools and gradually solidifies to form an ingot. This solidification occurs during cooling and involves the growth of dendrites 10, as illustrated in FIG. 3. In agreement with the phase diagram for stainless martensitic steels, the dendrites 10, corresponding to the first solidified grains, are by definition richer in alphagenic elements, while the interdendritic regions 20 are richer in gammagenic elements (application of the known lever rule for phase diagrams). An alphagenic element is an element that favors a ferritic type structure (structures that are more stable at low temperatures: bainite, ferrite-pearlite, martensite). A gammagenic element is an element that favors an austenitic structure (a structure that is stable at high temperatures). Thus, segregation occurs between the dendrites 10 and the interdendritic regions 20.

This local segregation in the chemical composition is then retained throughout fabrication, even during subsequent hot forming operations. Thus, this segregation is found both in the as-solidified ingot and in the subsequently deformed ingot.

Figure 5:
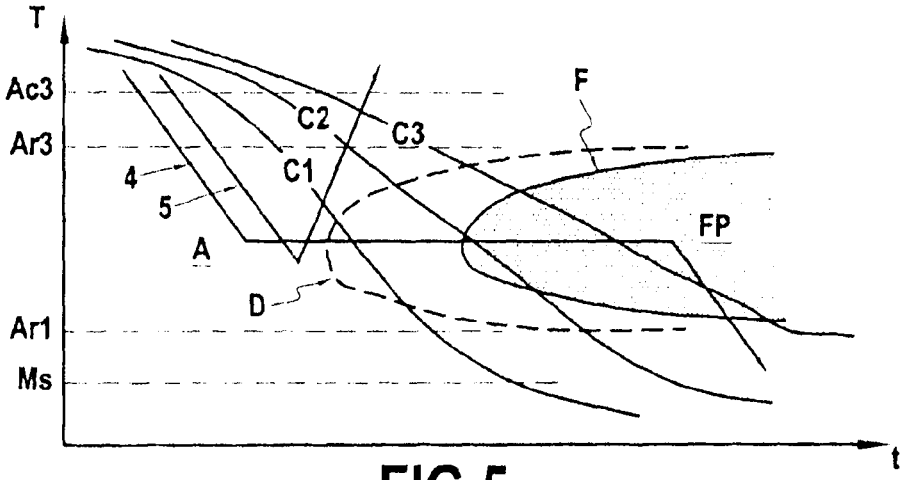
FIG. 5 is a time-temperature diagram of cooling curves for a region that is richer in alphagenic elements and less rich in gammagenic elements.
Figure 6:
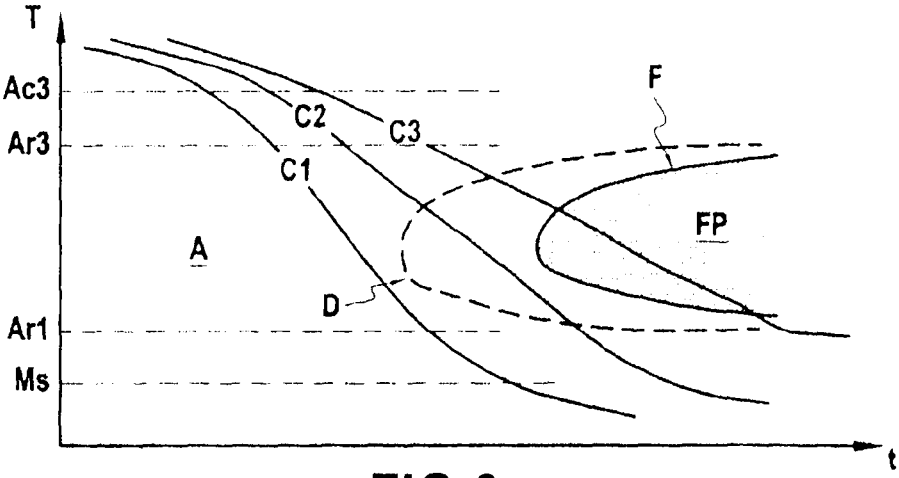
FIG. 6 is a time-temperature diagram of cooling curves for a region that is less rich in alphagenic elements and richer in gammagenic elements.

The inventors have been able to show that the results depend on the diameter of the ingot derived directly from the ESR crucible or from the ingot after hot deformation. This observation can be explained by the fact that the cooling rates decrease with increasing diameter. FIGS. 5 and 6 illustrate different scenarios that may occur.

FIG. 5 is a known temperature (T)-time (t) diagram for a region that is richer in alphagenic elements and less rich in gammagenic elements, such as dendrites 10. The curves D and F mark the onset and the end of the transformation from austenite (region A) to the ferritic-pearlitic structure (region FP). This transformation occurs, partially or fully, when the cooling curve that the ingot follows passes respectively into the region between the curves D and F or also into the region FP. It does not occur when the cooling curve is located entirely in the region A.

FIG. 6 is an equivalent diagram for a region that is richer in gammagenic elements and less rich in alphagenic elements, such as the interdendritic regions 20. It should be noted that compared with FIG. 5, curves D and F are shifted towards the right, i.e. the ingot needs to be cooled more slowly in order to obtain a ferritic-pearlitic structure.

Each of FIGS. 5 and 6 shows three cooling curves from an austenitic temperature, corresponding to three cooling rates: rapid (curve C1), medium (curve C2), slow (curve C3).

During cooling, the temperature starts to decrease from an austenitic temperature. In air, for the diameters of interest, the cooling rates of the surface and of the core of the ingot are very close. The only difference arises from the fact that the surface temperature is lower than that of the core since the surface cools before the core.

With cooling more rapid than the rapid cooling (curve C1) (FIGS. 5 and 6), ferritic-pearlitic transformations do not occur.

With rapid cooling in accordance with curve C1, the transformations are only partial, solely in the dendrites (FIG. 5).

With medium cooling in accordance with curve C2, the transformations are only partial in the interdendritic spaces 20 (FIG. 6) and quasi-complete in the dendrites 10 (FIG. 5).

With slow cooling in accordance with curve C3 and for even slower cooling, the transformations are almost complete both in the interdendritic spaces 20 and in the dendrites 10.

With rapid (C1) or medium (C2) cooling, cohabitation occurs to a greater or lesser extent between the ferritic regions and the austenitic regions.

Once the material has solidified, the dendrites 10 are initially transformed into ferritic structures during cooling (by passing through the curves D and F of FIG. 5). However, the interdendritic regions 20 are either not transformed (in the event of rapid cooling in accordance with curve C1) or are subsequently transformed, in part or in full (in the event of medium cooling in accordance with curve C2 or slow cooling in accordance with curve C3), at lower temperatures (see FIG. 6).

The interdendritic regions 20 thus retain an austenitic structure for longer.

During said solid state cooling, a local structural heterogeneity exists with cohabitation of austenitic and ferritic type microstructures. Under these conditions, light elements (H, N, O), which are more soluble in the austenite than in the ferritic structures, have a tendency to become concentrated in the interdendritic regions 20. This concentration is increased by the larger quantity of gammagenic elements in the interdendritic regions 20. At temperatures of less than 300° C., the light elements diffuse only at extremely low rates and remain trapped in their region. After complete or partial transformation of the interdendritic zones 20 into a ferritic structure, the solubility limit of these gas phases is reached under certain concentration conditions and these gas phases form pockets of gas (or of a substance that is in a physical state that provides high malleability and incompressibility).

During the cooling stage, the larger the diameter of the ingot (or the subsequently deformed ingot) at the end of the ESR (or, more generally, the larger the maximum dimension of the ingot), or the lower the cooling rate of the ingot, the greater is the tendency for the light elements to diffuse from the dendrites 10 with a ferritic structure towards the interdendritic regions 20 with a completely or partially austenitic structure where they become concentrated during the period of cohabitation of ferritic and austenitic structures. The risk of the solubility of these light elements being locally exceeded in the interdendritic regions is accentuated. When the concentration of light elements exceeds this solubility, microscopic gas pockets containing said light elements then appear in the steel.

In addition, while cooling is finishing, the austenite of the interdendritic regions tends to be transformed locally into martensite when the temperature of the steel falls below the martensitic transformation temperature Ms, which is slightly above ambient temperature (FIGS. 5 and 6). However, martensite has a solubility threshold for light elements that is even lower than the other metallurgical structures and than austenite. Thus, more microscopic gas phases appear in the steel during this martensitic transformation.

During subsequent deformations that the steel undergoes during hot forming (for example forging), these phases flatten out into a sheet form.

Under fatigue loading, these sheets act as stress concentration sites that are responsible for premature initiation of cracks by reducing the energy necessary for crack initiation. This then results in premature failure of the steel, which gives rise to the low values in the fatigue behavior results.

Figure 4:
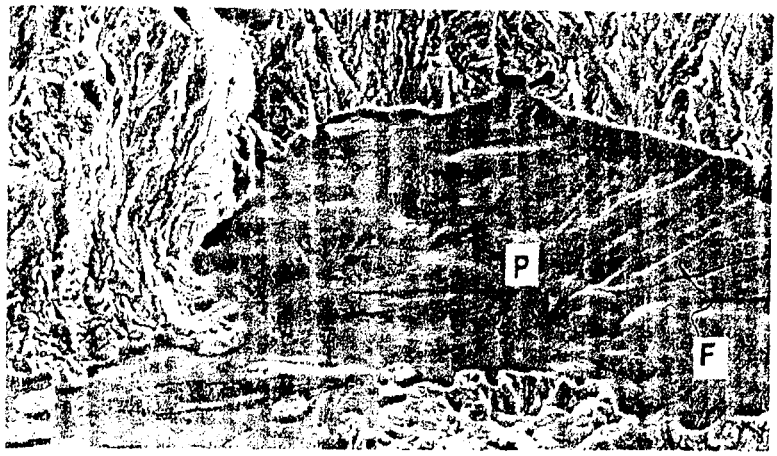
FIG. 4 is a photograph taken using an electron microscope of a fracture surface after fatigue, showing the gas phase that initiated that fracture.

These conclusions have been corroborated by the inventors' observations, as shown in the electron microscope photograph of FIG. 4.

On this photograph of a fracture surface of a stainless martensitic steel, a substantially globular zone P can be seen from which cracks F radiate. This zone P is the footprint of the gas phase constituted by light elements that is at the origin of the formation of these cracks F that, by propagating and agglomerating, have created a macroscopic fracture zone.

The inventors have carried out tests on stainless martensitic steels and have found that the fatigue results are improved when a precautionary heat treatment of the invention is carried out on these steels during cooling of the ingot immediately after removing it from the ESR crucible as well as immediately after each of the austenitic thermal cycles at an austenitic quality temperature (possibly comprising hot forming) carried out subsequently to ESR remelting. Such a precautionary heat treatment is described below, corresponding to a first implementation of the invention.

In accordance with the first implementation of the invention, while it is cooling at the end of the austenitic thermal cycle, or after it has been removed from the ESR crucible and before the temperature of the skin of the ingot falls below the martensitic transformation start temperature Ms, the ingot is placed in and held in a furnace at a temperature, termed the "holding" temperature, that lies in the range between the ferritic-pearlitic start and completion temperatures on cooling, Ar1 and Ar3 (the "ferritic-pearlitic nose", the region to the right of the curve F, FIGS. 5 and 6), for at least a hold time t, as soon as the temperature of the coolest point of the ingot has reached the holding temperature. This time is longer than (for example at least twice) the period necessary to transform the austenite into a ferritic-pearlitic structure at this holding temperature as completely as possible.

The mechanisms are illustrated by the diagrams of FIGS. 5 and 6, and in particular by the cooling curves C1, C2, and C3, already discussed above. These cooling curves show the mean temperature change of the ingot (surface and core) for various increasing thicknesses. This temperature starts to decrease from an austenitic temperature. Before the austenitic regions are transformed into martensite, i.e. before the temperature of the ingot skin falls below Ms, said ingot is placed in and then held in a furnace. Thus, the cooling curve becomes horizontal (curve 4 in FIG. 5, which corresponds to the treatment of the invention).

When the ferritic-pearlitic transformation is complete (curve 4 penetrates into the region FP to the right of the curve F), the ingot is allowed to cool to ambient temperature.

Once at ambient temperature, it is possible to deposit the ingot on any surface, for example the ground. The fact that the ingot can be deposited at any time during fabrication in this manner means that flexibility at the fabrication site is considerably increased, thereby improving logistics and costs.

During cooling from the austenitic temperature, the temperature of the ingot is more than 300° C. for most of the time, which encourages diffusion of light elements within the ingot. As soon as the surface temperature of the ingot is higher than that of the core of the ingot, degassing occurs in the ingot, which advantageously reduces its gaseous element content.

The inventors have experimentally determined that when, during each cooling stage following an austenitic thermal cycle, and during cooling after removal from the ESR crucible, a precautionary heat treatment is carried out on the ingot as described above, the formation of light element gas phases in the ingot is reduced.

In effect, there are no more variations in the concentrations of light elements (H, N, O) from one zone of the ingot to another, and thus there is a lower risk of exceeding the solubility of said phases in a given zone of the ingot. As a consequence, a preferential concentration of light elements is not created in any of the zones.

After the precautionary heat treatment in accordance with the first implementation of the invention, it is possible for the ingot to undergo one or more austenitic cycles.

Another precautionary heat treatment is described below, corresponding to a second implementation of the invention.

In accordance with the second implementation of the invention, during cooling from an austenitic temperature (temperature above the austenitic transformation completion temperature on heating, Ac3), before its minimum temperature (normally the skin temperature) falls below the martensitic transformation start temperature Ms, the ingot is placed in a furnace at a temperature that is higher than the Ac3 temperature. This is done when a subsequent austenitic thermal cycle is planned at a temperature above Ac3 just after cooling following a prior austenitic cycle, or following the ESR method). The ingot is thus held in said furnace for at least the time necessary for the coolest portion of the ingot to heat up above Ac3, the ingot then immediately undergoing a subsequent austenitic thermal cycle. Curve 5 in FIG. 5 corresponds to this treatment of the invention.

If, after this subsequent austenitic thermal cycle, one or more other austenitic thermal cycles is/are carried out, the hold in the furnace of the ingot as described above is carried out between two successive austenitic thermal cycles.

The inventors have determined experimentally that when the minimum temperature of the ingot between two austenitic thermal cycles is not allowed to fall below the martensitic transformation start temperature Ms, the formation of light element gas phases in the ingot is reduced.

In fact, the austenitic structure in the ingot is always homogeneous, and the concentration of light elements is homogeneous; as a consequence, the risk of exceeding the solubility of gas phases in a given zone of the ingot is constant, and is lower.

In addition, during said cooling from the austenitic temperature, the temperature of the ingot is more than 300° C. for most of the time, allowing light elements to diffuse within the ingot. At the moment when the surface temperature of the ingot once again exceeds or is equal to that of the ingot core, degassing occurs in the ingot, which advantageously reduces the gas element content therein.

In addition, at austenitic temperatures, diffusion of alloying elements from zones with a high concentration towards zones with a low concentration allows the intensity of segregations into alphagenic elements in the dendrites 10 to be reduced and allows the intensity of segregations into gammagenic elements in the interdendritic regions 20 to be reduced. Reducing the intensity of segregations into these gammagenic elements results in a reduction in the difference in solubility of the light elements (H, N, O) between the dendrites 10 and the interdendritic regions 20, resulting in better homogeneity in terms of structure (less cohabitation of austenitic and ferritic structures) and of chemical composition, including light elements.

The term "intensity of a segregation" of an element means the offset between the concentration of that element in a zone where said concentration is a minimum and the concentration of said element in a zone where said concentration is a maximum.

After the last austenitic thermal cycle, the ingot is held in the ferritic-pearlitic transformation nose for a period sufficient to obtain a quasi-complete ferritic-pearlitic transformation, in agreement with the first implementation of the invention, which means that the ingot can be deposited at ambient temperature.

As an example, with a Z12CNDV12 stainless martensitic steel (AFNOR standard) used by the inventors in the tests, the ferritic-pearlitic transformation nose is in the temperature T band between 550° C. and 770° C. Temperatures T in the range 650° C. to 750° C. are optimal, and the ingot must be held for a time t in the range 10 hours to 100 hours. For temperatures either in the range 550° C. to 650° C. or else in the range 750° C. to 770° C., the hold time is in the range 100 h [hours] to 10000 h.

For such a steel, the temperature Ms is of the order of 200° C.-300° C.

The inventors have observed that one of the precautionary heat treatments dealing with gas phases as described above is especially necessary when:

the maximum dimension of the ingot before cooling is less than approximately 910 mm [millimeter] or the minimum dimension is more than 1500 mm, and the H content of the ingot before electroslag remelting is more than 10 ppm; and the maximum dimension of the ingot before cooling is more than approximately 910 mm and the minimum dimension of the ingot is less than approximately 1500 mm, and the H content of the ingot before electroslag remelting is more than 3 ppm.

The maximum dimension of the ingot is that of its measurements in its bulkiest portion and the minimum dimension of the ingot is that of its measurements in its least bulky portion:

a. immediately after electroslag remelting when the ingot does not undergo hot forming before its subsequent cooling;

b. when the ingot undergoes hot forming after electroslag remelting, just before its subsequent cooling.

Preferably, the slag is dehydrated before being used in the ESR crucible. In fact, it is possible for the concentration of H in the steel ingot from electroslag remelting, ESR, to be higher than the concentration of H in said ingot before its electroslag remelting. Hydrogen can then pass from the slag into the ingot during the ESR method. By dehydrating the slag in advance, the quantity of hydrogen present in the slag is minimized and thus the quantity of hydrogen that could pass from the slag into the ingot during the ESR method is minimized.

The inventors carried out tests on Z12CNDV12 steels, employing the following parameters:

Test No 1:

cool ingot on removal from ESR crucible (H content 8.5 ppm) when the skin temperature is 250° C., place in furnace at 690° C. and metallurgical hold (as soon as the coolest temperature of the ingot reaches the homogenization temperature) for 12 h, cool to ambient temperature;

cool after diameter upsetting operation between 910 mm and 1500 mm, when the skin temperature is 300° C., place in furnace at 690° C. and metallurgical hold for 15 h, cool to ambient temperature; and cool, after drawing to smaller diameter operation at 900° C., to ambient temperature.

Test No 2:

cool ingot on removal from ESR crucible (H content 7 ppm) when the skin temperature is 270° C., place in furnace at 700° C. and metallurgical hold (as soon as the coolest temperature of the ingot reaches the homogenization temperature) for 24 h, cool to ambient temperature;

cool after diameter upsetting operation between 910 mm and 1500 mm, when the skin temperature is 400° C., place in furnace at 690° C. and metallurgical hold for 10 h, cool to ambient temperature; and cool, after drawing to smaller diameter operation at 900° C., to ambient temperature.

Test No 3:

cool ingot on removal from ESR crucible (H content 8.5 ppm) when the skin temperature is 450° C., place in furnace at 1150° C. for upsetting. Cool after diameter upsetting operation between 910 mm and 1500 mm, when the skin temperature is 350° C., place in furnace at 690° C. and metallurgical hold for 15 h, cool to ambient temperature; and cool, after drawing to smaller diameter operation at 900° C., to ambient temperature.

Test No 4:

cool ingot on removal from ESR crucible (H content 12 ppm) when the skin temperature is 230° C., place in furnace at 690° C. and metallurgical hold (as soon as the coolest temperature of the ingot reaches the homogenization temperature) for 24 h, cool to ambient temperature;

cool after diameter upsetting operation between 910 mm and 1500 mm, when the skin temperature is 270° C., place in furnace at 690° C. and metallurgical hold for 24 h, cool to ambient temperature;

cool after drawing operation to diameter at less than 900° C. when the skin temperature is 650° C., place in furnace at 1150° C. for second draw; and on cooling, when the skin temperature is 320° C., place in furnace at 690° C. and metallurgical hold for 15 h, cool to ambient temperature. At this stage, the hydrogen measurement was 1.9 ppm.

Test No 5:

cool ingot on removal from ESR crucible (H content 8.5 ppm) when the skin temperature is 450° C., place in furnace at 1150° C. for upsetting;

cool after diameter upsetting operation between 910° mm and 1500 mm, when the skin temperature is 350° C., place in furnace at 690° C. and metallurgical hold for 15 h, cool to ambient temperature; and cool after drawing operation to a diameter of less than 900° C. to ambient temperature.

The results of these tests are presented below.

The composition of the Z12CNDV12 steels was as follows (DMD0242-20 standard, index E):

C (0.10% to 0.17%)-Si (<0.30%)-Mn (0.5% to 0.9%)-Cr (11% to 12.5%)-Ni (2% to 3%)-Mo (1.50% to 2.00%)-V (0.25% to 0.40%)-$N_2$ (0.010% to 0.050%)-Cu (<0.5%)-S (<0.015%)-P (<0.025%), and satisfying the criterion:

$$4.5 \leq (Cr-40.C-2.Mn-4.Ni+6.Si+4.Mo+11.V-30.N) < 9$$

The measured martensitic transformation temperature Ms was 220° C.

The quantity of hydrogen measured in the ingots before electroslag remelting varied in the range 3.5 ppm and 8.5 ppm.

Figure 1:
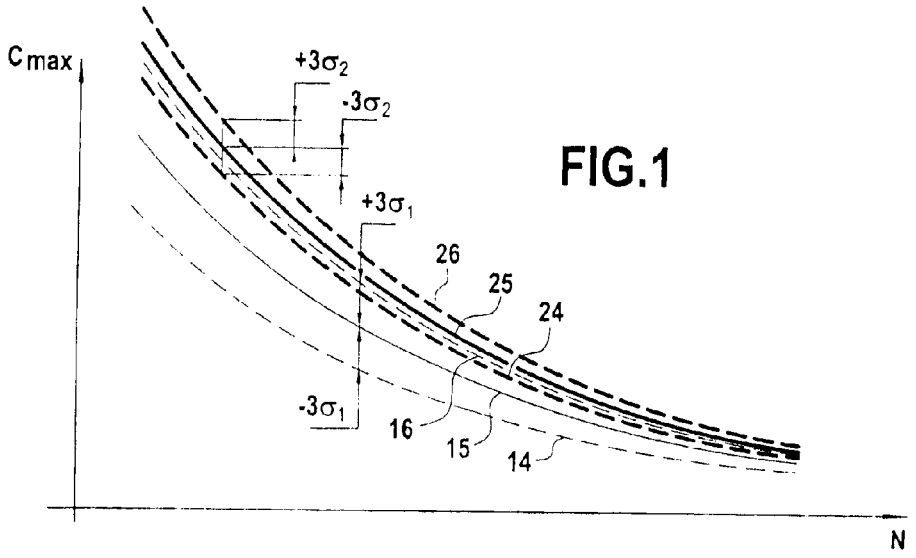
FIG. 1 compares the fatigue service life curves for a steel of the invention and a prior art steel.

FIG. 1 qualitatively shows the improvements brought about by the method of the invention. Experimentally, a value was obtained for the number N of cycles to breaking needed to break a steel specimen subjected to cyclic tensile loading as a function of the pseudo alternating stress C (the load on the specimen under imposed deformation, in accordance with Snecma standard DMC0401 used for these tests).

Figure 2:
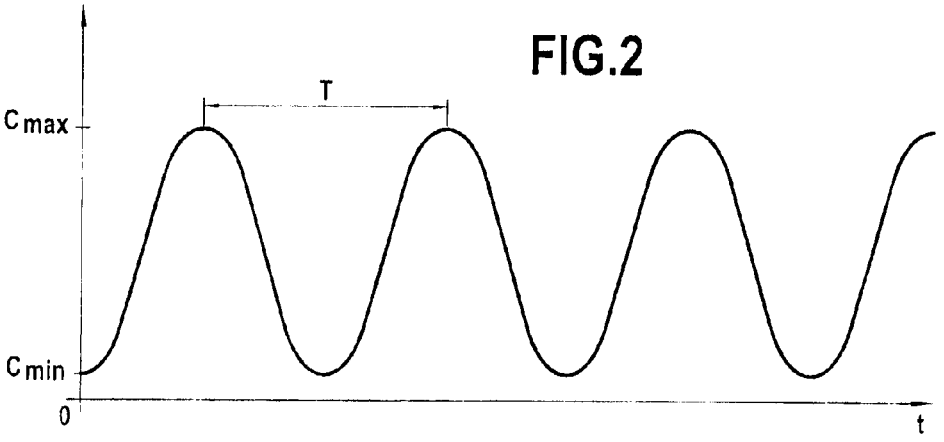
FIG. 2 shows a fatigue loading curve.

Such a cyclic loading is shown diagrammatically in FIG. 2. The period T represents one cycle. The stress changes between a maximum value $C_{max}$ and a minimum value $C_{min}$.

By fatigue testing a statistically sufficient number of specimens, the inventors obtained points N=f(C) from which they drew up a mean statistical C-N curve (stress C as a function of the number N of fatigue cycles). The standard deviations for the loads were than calculated for a given number of cycles.

In FIG. 1, the first curve 15 (narrow line) is (diagrammatically) the mean curve obtained for a steel produced in accordance with the prior art. This first mean C-N curve is between two curves 16 and 14 shown as narrow dashed lines. These curves 16 and 14 are located respectively at a distance of $+3\sigma_1$ and $-3\sigma_1$ from the first curve 15, $\sigma_1$ being the standard deviation of the distribution of the experimental points obtained during these fatigue tests; $\pm 3\sigma_1$ corresponds in statistics to a confidence interval of 99.7%. The distance between these two dashed line curves 14 and 16 is thus a measure of the dispersion of the results. The curve 14 is the limiting factor for the dimensions of a part.

In FIG. 1, the second curve 25 (thick line) is (diagrammatically) the mean curve obtained from the fatigue test results carried out on a steel produced in accordance with the invention under loading in accordance with FIG. 2. This second mean C-N curve lies between two curves 26 and 24 shown as thick dashed lines, located respectively at a distance of +3(2 and −3(2 from the second curve 25, (2 being the standard deviation of the experimental points obtained during these fatigue tests. The curve 24 is the limiting factor for the dimensions of a part.

It should be noted that the second curve 25 is located above the first curve 15, which means that under a fatigue Loading at a loading level C, steel specimens produced in accordance with the invention break on average at a higher number N of cycles than that at which the prior art steel specimens break.

In addition, the distance between the two curves 26 and 24 shown as thick dashed lines is smaller than the distance between the two curves 16 and 14 shown as thin dashed lines, which means that the fatigue behavior dispersion of the steel produced in accordance with the invention is smaller than that of a prior art steel.

FIG. 1 illustrates the experimental results summarized in Table 1 below.

Table 1 gives the results for oligocyclic fatigue loading in accordance with FIG. 2 with a zero minimum stress Cmin, at a temperature of 250° C., with N=20000 cycles, and N=50000 cycles. "Oligocyclic fatigue" means that the loading frequency is of the order of 1 Hz (the frequency being defined as the number of periods T per second).

TABLE 1

| Oligocyclic fatigue test conditions | | Prior art steel | | Steel produced in accordance with invention | |
|---|---|---|---|---|---|
| N | Temperature | Cmin | Dispersion | Cmin | Dispersion |
| 2 × 105 | 200° C. | 100% = M | 120% M | 130% M | 44% M |
| 5 × 104 | 400° C. | 100% = M | 143% M | 130% M | 90% M |

It should be noted that for a given value of the number of cycles N, the minimum fatigue loading value necessary to break a steel of the invention is higher than the minimum value M for the fatigue loading (fixed at 100%) necessary to break a prior art steel. The dispersion (=6( ) for the results at this number N of cycles for a steel of the invention is smaller than the dispersion for the results for a prior art steel (dispersions expressed as a percentage of the minimum value M).

Advantageously, the carbon content of the stainless martensitic steel is lower than the carbon content below which the steel is hypoeutectoid, for example a content of 0.49%. In fact, a low carbon content allows better diffusion of the alloying elements and a reduction in the solution temperatures for primary or noble carbides, which results in better homogenization.

Before electroslag remelting, a martensitic steel, for example, will have been produced in air.

The first implementation of the invention may also be applied to an ingot when cooling it on removal from the ESR crucible; the ingot then does not undergo any austenitic thermal cycles.

The invention claimed is:

1. A method of fabricating a stainless martensitic steel, comprising:

an electroslag remelting of an ingot of steel;

a first cooling of the ingot, wherein before a minimum temperature of the ingot falls below a martensitic transformation start temperature, either interrupting the first cooling by holding the ingot at a temperature above an austenitic transformation completion temperature on heating until commencement of a subsequent austenitic thermal cycle, or holding the ingot at a holding temperature included in a ferritic-pearlitic transformation nose for a hold time that is longer than a transformation period sufficient for transforming austenite into a ferritic-pearlitic structure in the ingot as completely as possible at the holding temperature;

subjecting the ingot to at least one austenitic thermal cycle comprising heating the ingot above an austenitic temperature of the ingot and a second cooling step of cooling the ingot, wherein for the second cooling step:

when the second cooling step is not followed by another austenitic thermal cycle, the method further comprises a second holding wherein the ingot is held at the holding temperature included for the hold time, the second holding being carried out as soon as the temperature of the coolest point of the ingot has reached the holding temperature;

when the second cooling step is followed by another austenitic thermal cycle, before a minimum temperature of the ingot falls below the martensitic transformation start temperature, the method further comprises either interrupting the second cooling by holding the ingot at a temperature above an austenitic transformation completion temperature on heating until commencement of a subsequent austenitic thermal cycle, or holding the ingot at the holding temperature for the hold time.

2. The method of fabricating a stainless martensitic steel according to claim 1, wherein the method is carried out on the steel in one of the following circumstances:

the maximum dimension of the ingot before the first or second cooling is less than approximately 910 mm or the minimum dimension is more than 1500 mm, and the H content of the ingot before electroslag remelting is more than 10 ppm; and the maximum dimension of the ingot before the first or second cooling is more than approximately 910 mm and the minimum dimension of the ingot is less than approximately 1500 mm, and the H content of the ingot before electroslag remelting is more than 3 ppm.

3. The method of fabricating a stainless martensitic steel according to claim 1, wherein the slag used in the remelting step has been dehydrated in advance.

4. The method of fabricating a stainless martensitic steel according to claim 1, wherein carbon content of the steel is less than carbon content below which the steel is hypoeutectoid.

5. The method of fabricating a stainless martensitic steel according to claim 1, wherein the ingot is held at temperature by placing the ingot in a furnace.

6. The method of fabricating a stainless martensitic steel according to claim 5, wherein the ingot is placed in the furnace before the temperature of a skin of the ingot falls below the ferritic-pearlitic completion temperature on cooling.

7. A method of fabricating a stainless martensitic steel, comprising:

an electroslag remelting of an ingot of steel; and a cooling of the ingot, wherein, for the cooling step, the ingot is held at a holding temperature included in a ferritic-pearlitic transformation nose for a hold time that is longer than a period necessary to transform austenite into a ferritic-pearlitic structure in the ingot at the holding temperature as completely as possible, the holding step being carried out as soon as a temperature of a coolest point of the ingot has reached the holding temperature, the ingot not undergoing an austenitic thermal cycle after the electroslag remelting.

8. The method of fabricating a stainless martensitic steel according to claim 1, comprising the electroslag remelting, then the first cooling, then the at least one austenitic thermal cycle comprising the heating and the second cooling.

* * * * *